US008696351B2

(12) United States Patent
Huang et al.

(10) Patent No.: US 8,696,351 B2
(45) Date of Patent: Apr. 15, 2014

(54) MULTI-PURPOSE HEAT-COLLECTING KILN DEVICE

(76) Inventors: Kang-Ming Huang, Chia-Yi (TW); Tsung-Wei Huang, Chia-Yi (TW)

( * ) Notice: Subject to any disclaimer, the term of this patent is extended or adjusted under 35 U.S.C. 154(b) by 331 days.

(21) Appl. No.: 13/279,379

(22) Filed: Oct. 24, 2011

(65) Prior Publication Data

US 2013/0101950 A1 Apr. 25, 2013

(51) Int. Cl.
*F27D 5/00* (2006.01)

(52) U.S. Cl.
USPC ..... 432/264; 432/253

(58) Field of Classification Search
USPC ..... 432/253, 254.1, 258, 261, 262, 264, 432/265, 248; 206/503–513; 264/57, 58, 264/614
See application file for complete search history.

(56) References Cited

U.S. PATENT DOCUMENTS

| | | | | |
|---|---|---|---|---|
| 4,815,971 | A * | 3/1989 | Bucher | 432/239 |
| 5,226,558 | A * | 7/1993 | Whitney et al. | 220/571 |
| 5,628,849 | A * | 5/1997 | Fasano et al. | 264/614 |
| 5,755,570 | A * | 5/1998 | Shinde et al. | 432/253 |
| 7,964,949 | B2 * | 6/2011 | Lai et al. | 257/686 |
| 2009/0096077 | A1 * | 4/2009 | Lai et al. | 257/686 |

* cited by examiner

*Primary Examiner* — Gregory A Wilson
(74) *Attorney, Agent, or Firm* — Symbus Law Group LLC; Clifford D. Hyra

(57) ABSTRACT

A heat-collecting kiln device includes a housing assembly including a single housing or a plurality of housings having a same height or different heights, with the housings stackable one upon another. A top lid is mounted on a top of the housing assembly to seal the housing assembly and includes an observation hole. A base is mounted to a bottom of the housing assembly to seal the housing assembly. A cover is mounted to the top lid to seal the observation hole. The cover is removable to reveal the observation hole. The heat-collecting kiln device further includes a net and at least one leg. Each housing is comprised of four modular elements each having a mortise engaged with a tenon of another modular element. One of the modular elements includes a temperature detection hole.

4 Claims, 3 Drawing Sheets

MULTI-PURPOSE HEAT-COLLECTING KILN DEVICE

BACKGROUND OF THE INVENTION

The present invention relates to a heat-collecting kiln device and, more particularly, to a heat-collecting kiln device that can be used on differing heating devices, such as household microwaves or gas stoves, to sinter a handiwork.

After having finished a handiwork at the end of a handiwork class of metal working, ceramics, or liuli, it is not uncommon to receive the notice of retrieval of the handiwork after a couple of weeks or even longer. It would be a problem to the students who forgot to sign on the handiworks. The last student retrieving the last handiwork may doubt whether the ugly handiwork is his or her work or not.

Conventionally, when sintering dried blanks formed of inorganic powders of metal or ceramic or of melting glass (liuli), enamel, and cloisonné, the workpieces are placed in a temperature-controllable electric kiln or gas kiln and then heated to produce the required ornamental handiworks.

Both of the electric kiln and gas kiln are bulky and provide slow heating effect while having a large temperature difference inside the kiln. It is time-consuming and laborious to sinter a small amount of small workpieces in addition to a waste of energy and space. Furthermore, heating of the workpieces is uneven. Namely, the electric kiln and gas kiln are only suitable to sinter a large amount of large workpieces requiring the same heating conditions. As a result, when using an electric kiln or gas kiln, the heating processing can only begin after the kiln is full with the workpieces, which requires patience. When sintering handiworks of students, flaws may occur due to differing materials and differing handiworks, and the flaws of a handiwork may spread to surrounding handiworks. Furthermore, it is inconvenient and dangerous during placement and removal of the handiworks due to limitation of the space receiving the handiworks. Another option is a small electric kiln generally for experimental purposes. However, the electric kiln is expensive and has many limitations to the use of the space. Furthermore, the electric kiln can not or is difficult to control the atmosphere for oxidization or reduction.

A further option is a hand-held gas burner that directly heats the blank in an open space. The worker can adjust the temperature by the naked eye. Only a portable gas container and a gas stove are required to sinter the blank at any place. However, the hand-held gas burner has many disadvantages including incapability to maintain the temperature of the blank, waste of fuel, difficulties in controlling the atmosphere for oxidization or reduction and in uneven heating, instability of long-term hand-held operation, and potential risk of injury to the eyes or body of the worker.

Another option is a circular kiln stove made of hollow, lumpy, inorganic ceramic fibrous boards and including a hollow interior and a cylindrical surface. However, a considerable amount of material is wasted while preparing the hollow inorganic ceramic fibrous boards, which is not eco-friendly. Furthermore, due to the extending direction of the fibers of the inorganic fibrous boards, the kiln stove has poor thermal shock resistance, such that the kiln stove is liable to crack in the extending direction of the fibers when the temperature dramatically increases or decreases, leading to hazard. Further, the interior of the kiln oven is circular in cross section, which has a space-using efficiency in receiving the blanks poorer than a kiln including an interior that is square in cross section.

Thus, a need exists for heat-collecting kiln device that does not produce wasted materials and that will not trouble the user in the cost, installation space, placement of the blanks, and removal of the products. Furthermore, the products can be obtained soon after finish of the blanks. Further, everyone can make a unique artifact at home, because the working space is no longer a problem. Further, development of cultural creativeness can be enhanced. The space of the heat-collecting kiln device is larger than those of conventional kilns. The heat-collecting device is light, easy to carry, eco-friendly, and energy-saving and can serve multiple purposes, conduct and collect heat, and maintain temperature.

BRIEF SUMMARY OF THE INVENTION

The present invention provides a multi-purpose heat-collecting kiln device that is light, easy to carry, eco-friendly, and energy-saving and that can serve multiple purposes, conduct and collect heat, and maintain temperature.

A heat-collecting kiln device according to the present invention includes a housing assembly including a single housing or a plurality of housings having a same height or different heights, with the plurality of housings stackable one upon another. A top lid is mounted on a top of the housing assembly to seal the housing assembly and includes an observation hole. A base is mounted to a bottom of the housing assembly to seal the housing assembly. A cover is mounted to the top lid to seal the observation hole. The cover is removable to reveal the observation hole. The heat-collecting kiln device further includes a net and at least one leg.

Each of the plurality of housings is comprised of four modular elements each having a mortise in a first end thereof and a tenon on a second end thereof. The mortise of each of the plurality of modular elements is engaged with the tenon of another of the plurality of modular elements. The plurality of modular elements is bonded together by a heat-resistant inorganic adhesive to form the housing having upper and lower openings. One of the plurality of modular elements includes a temperature detection hole. Each of the plurality of modular elements is obtained by cutting an inorganic ceramic fibrous board in an extending direction of fibers of the inorganic ceramic fibrous board.

Preferably, a heat-conducting layer capable of absorbing waves and heat is coated to an exposed area of an interior wall of each of the housing assembly, the top lid, and the base.

Preferably, a protecting layer of heat-resistant inorganic hardening paint is applied to an area of the housing assembly that can come in contact with hands of a user.

The present invention will become clearer in light of the following detailed description of illustrative embodiments of this invention described in connection with the drawings.

DETAILED DESCRIPTION OF THE INVENTION

Figure 1:
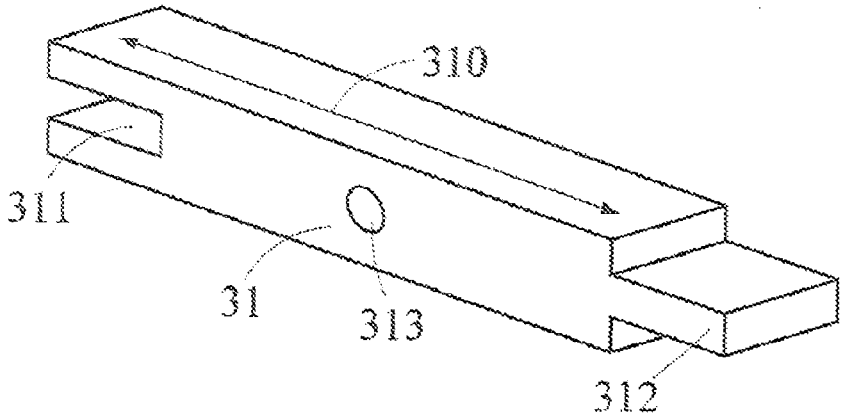
FIG. 1 shows a perspective view of a modular element for a heat-collecting kiln device according to the present invention.

FIG. 1 shows a modular element 31 according to the present invention. The modular element 31 allows transmission of microwaves to keep heat in an interior of the modular element 31. The modular element 31 is made of an inorganic ceramic fibrous board mainly consisting of aluminum oxide and mullite. The inorganic ceramic fibrous board is cut along an extending direction 310 of the fibers to form the modular element 31 having a length of 15 cm, a height of 5 cm, and a thickness of 2.5 cm. Furthermore, the modular element 31 includes a first end having a mortise 311 with a length of 2.5 cm and a second end having a tenon 312 having a length of 2.5 cm. A plurality of the modular elements 31 can be assembled through engagement of the tenons 312 and mortises 312 and through gluing to form a housing 3 having a height of 5 cm. Alternatively, the modular element 31 can be obtained by cutting a material that allows transmission of microwaves and that can keep heat, and the resultant size of the modular element 31 can have a length of 15 cm, a height of 2.5 cm, and a thickness of 2.5 cm. Furthermore, the modular element 31 includes a first end having a mortise 311 with a length of 2.5 cm and a second end having a tenon 312 with a length of 2.5 cm. A plurality of the modular elements 31 can be assembled through engagement of the tenons 312 and mortises 312 and through gluing to form a housing 3 having a height of 2.5 cm. To allow detection of temperature, the modular element 31 has a temperature detection hole 313.

Figure 2:
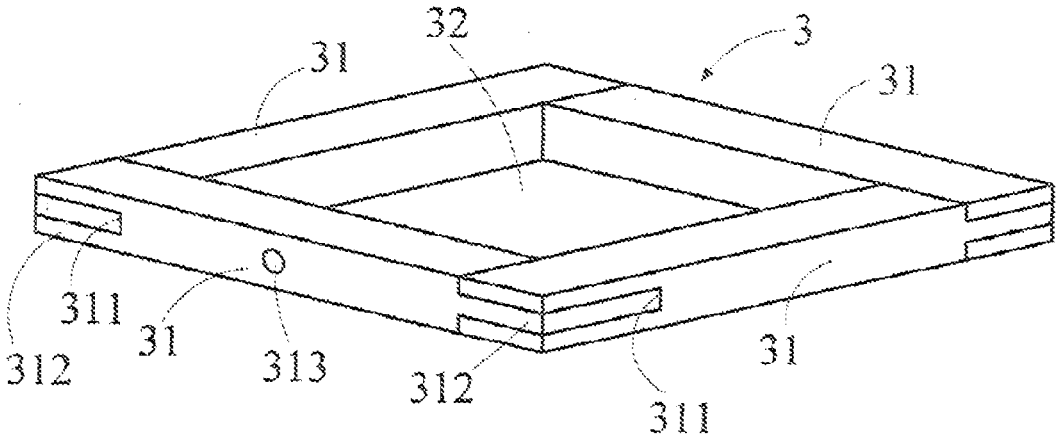
FIG. 2 shows a perspective view of a housing of the heat-collecting kiln formed by a plurality of the modular elements.

FIG. 2 shows a housing 3 comprised of four annularly disposed modular elements 31. The mortise 311 of each modular element 31 is engaged with the tenon 312 of another modular element 31. After engagement, the modular elements 31 are bonded together by a temperature-resistant inorganic adhesive to form a space 32 that is square in cross section. The space 32 can receive ornament workpieces and has top and bottom openings. The resultant housing 3 has a height of 5 cm if each modular element 31 has a height of 5 cm or of 2.5 cm if each modular element 31 has a height of 2.5 cm. Nevertheless, a housing 3 having a height of 5 cm can be assembled with a housing 3 having a height of 2.5 cm. Alternatively, a plurality of housings 3 having the same height can be assembled together. As an example, two housings 3 each having a height of 5 cm can be assembled together.

Preferably, the exposed area of an interior wall of the housing 3 can be coated (by using an inorganic adhesive) with a carbon-silicon compound-based heat-conducting layer 33 capable of absorbing waves and heat. To increase the structural strength during operation, a protecting layer 34 of heat-resistant inorganic hardening paint is preferably applied to any area of the housing that can come in contact with the hands of a user.

Figure 3:
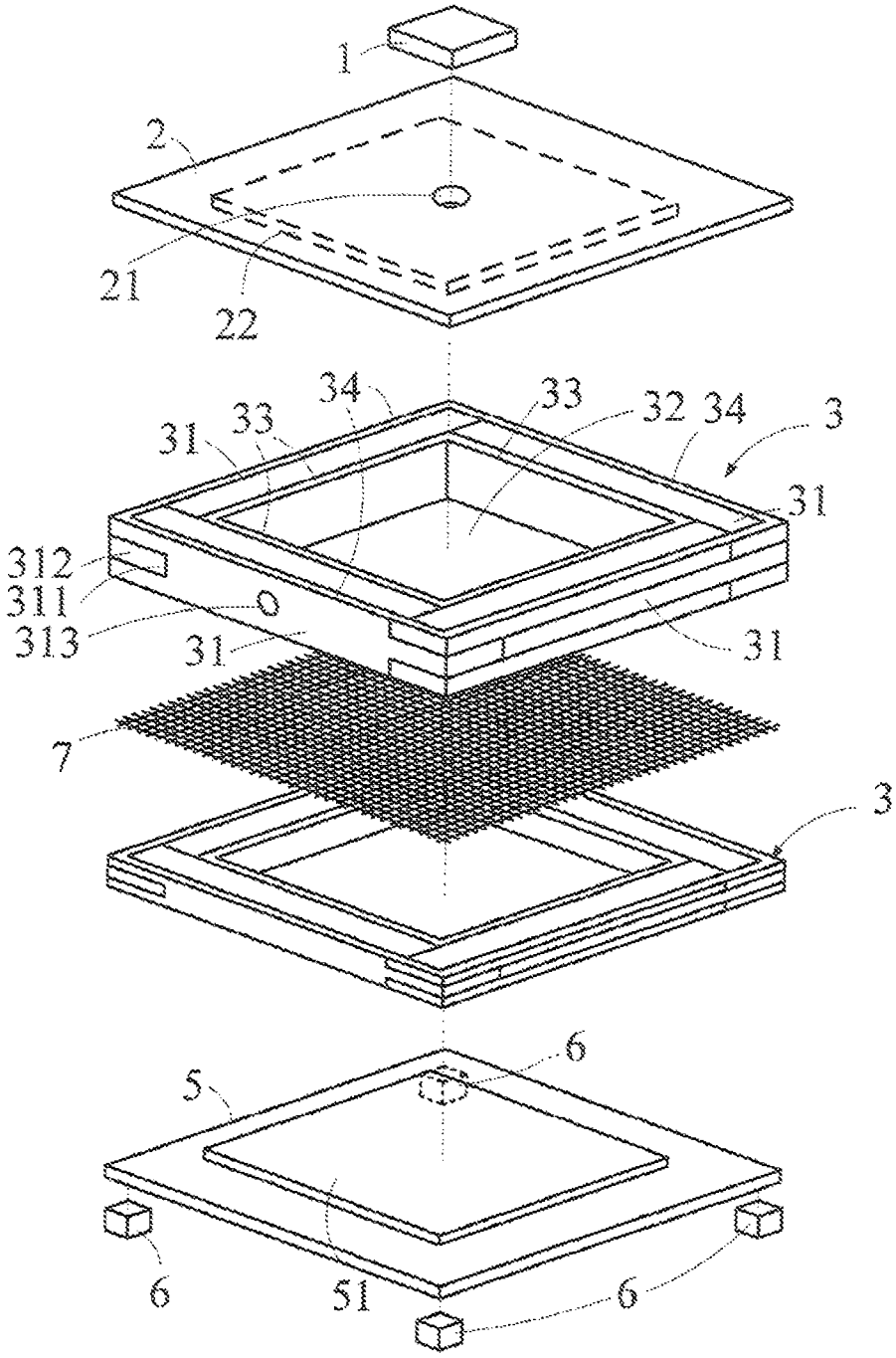
FIG. 3 shows an exploded, perspective view of the heat-collecting kiln device according to the present invention.

With reference to FIG. 3, two housings 3 of different heights can be stacked. A net 7 can be mounted between the housings 3. A top lid 2 is provided on top of the upper housing 3 for sealing the upper housing 3 and includes an observation hole 21. A base 5 made of inorganic ceramic fibrous board is mounted to a bottom side of the lower housing 3 for sealing the lower housing 3. Articles can be placed on the base 5. A cover 1 is placed on top of the top lid 2 and can cover the observation hole 21 when desired. Four legs 6 are mounted to a bottom side of the base 5 to allow adjustment of the overall height of the housing assembly comprised of the housings 3 and to increase the heat-insulating effect of the base 5. Preferably, the exposed area of an interior wall of each of the top lid 2 and the base 5 can be coated (by using an inorganic adhesive) with a carbon-silicon compound-based heat-conducting layer 22, 51 capable of absorbing waves and heat.

Figure 4:
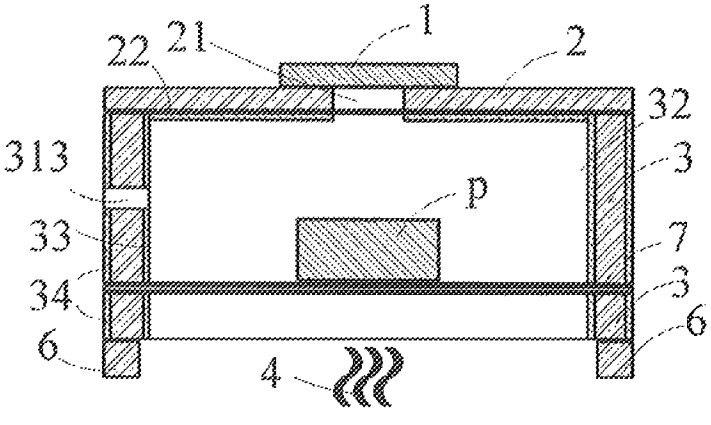
FIG. 4 shows a cross sectional view of an example of the heat-collecting kiln device placed above a gas stove.

FIG. 4 shows a cross sectional view of an example of the heat-collecting kiln device placed above a gas stove. As an example, a blank workpiece P of about 3-5 cm and made of copper clay are placed on the net 7 located between two housing 3 of different heights. A top lid 2 seals the upper housing 3. The observation hole 21 of the top lid 2 is sealed by the cover 1 that can be used to control air convection and the reduction atmosphere of the flame. The legs 6 support the housings 3. The kiln device is heated by the household gas stove with medium or big fire. The housings 3 concentrate, conduct, and break heat. The cover 1 can be removed, and the user can see the sintering condition of the workpiece P through the observation hole 21 by judging the color of emitted beams. When the workpiece P turns into orange red and slightly transparent, the sintering can be finished in about 5-10 minutes.

Figure 5:
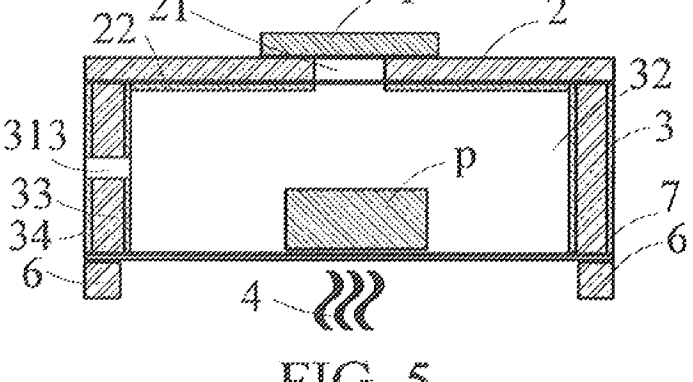
FIG. 5 shows a cross sectional view of another example of the heat-collecting kiln device placed above a gas stove.

If the distance between the blank workpiece P and the heat source 4 must be shorter, an arrangement of FIG. 5 can be made. As an example, a blank workpiece P of about 3-5 cm and made of copper clay are placed on the net 7 located between a housing 3 and four legs 6. The top lid 2 seals the housing 3. The observation hole 21 is sealed by the cover 1 that can be used to control air convection and the reduction atmosphere of the flame. The legs 6 support the housing 3. The kiln device is heated by the household gas stove with medium or big fire. The housing 3 concentrates, conducts, and breaks heat. The cover 1 can be removed, and the user can see the sintering condition of the workpiece P through the observation hole 21 by judging the color of emitted beams. When the workpiece P turns into orange red and slightly transparent, the sintering can be finished in about 5-10 minutes.

The main ingredient of the metal clay is copper powders mixed with a small amount of organic adhesive. The sintering operation can be accomplished in a temperature range of 760-1000° C. The higher the temperature, the shorter the sintering time. The fuel for a household gas stove is generally methane, propane, or butane, which is suitable for sintering of blanks made of ordinary metal and inorganic powders or of glass, ceramic, enamel, or cloisonné. Furthermore, methane, propane, and butane allow easy control of the atmosphere of oxidization or reduction during sintering. While the temperature of the blank workpiece P is kept by the heat-collecting kiln device according to the present invention, the atmosphere of oxidization or reduction for controlling the temperature can be achieved through use of the observation hole 21 of the top lid 2. The heat-collecting kiln device according to the present invention can achieve the sintering in a short period of time by simple proceeding. The reduction atmosphere can be obtained by using gas as the fuel. No dangerous hydrogen or complicated reduction conditions (such as carbonthermal reduction) are required. Thus, the expensive equipment and complicated proceeding are not necessary, and art creation can be accomplished in the kitchen of an ordinary house.

Figure 6:
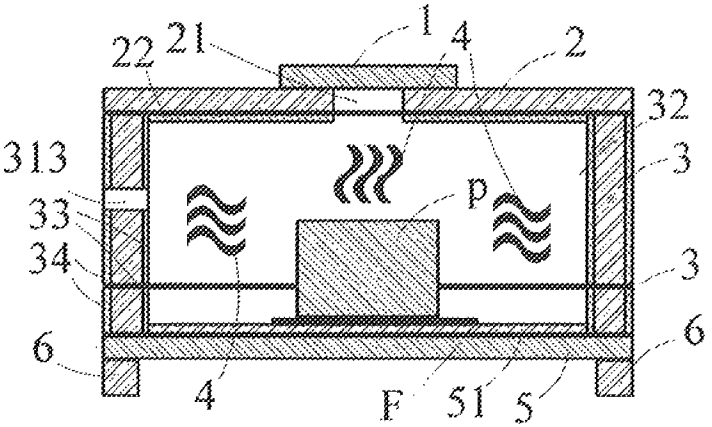
FIG. 6 shows a cross sectional view of an example of the heat-collecting kiln device placed in a microwave stove.

FIG. 6 shows a cross sectional view of an example of the heat-collecting kiln device placed in a microwave stove. The different between the example using microwave as the heat source and the example using the gas stove as the heat source is that the base 5 replaces the net 7. As an example, recycled glass of wine bottle shards is arranged to form a workpiece P of 3 cm×3 cm×0.6 cm. The workpiece P is placed on a piece of inorganic heat-resistant paper F on the base 5 that is supported by four legs 6. Two housings 3 of different heights are stacked on top of the base 5. The upper housing 3 is sealed by a top lid 2 having an observation hole 21. The kiln device comprised of the legs 6, base 5, housings 3, and top lid 2 is placed in a household microwave (such as model RE-0706R of Sampo Corporation, the power source is 110V/60 Hz, the frequency is 2450 MHz, and the rated microwave output is 800 W). The workpiece P is sintered by big wire through microwaves. The housings 3 concentrate, conduct, and break heat. The user can see the sintering condition of the workpiece P through the observation hole 21 by judging the color of emitted beams. When the beams turns from dark red (about 700° C.) into orange red (about 800° C.), the sintering can be finished in about 1 minute. The kiln device is then took out of microwave stove and slowly cooled to the room temperature, finishing the melting. It takes about 8 minutes from heating to complete melting by using the microwaves. After microwave sintering, the heat-collecting kiln device according to the present invention is removed out of the microwave stove. After opening the top lid 2, reducing substances (such as carbon, wood dust, or dry leaves) are placed into the heat-collecting kiln device. Thus, reduction sintering can be accomplished by using the characteristics of temperature maintaining, conducting, and collection of the kiln device.

Figure 7:
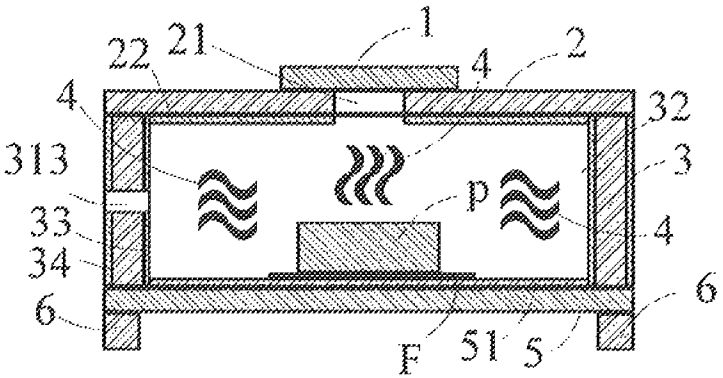
FIG. 7 shows a cross sectional view of another example of the heat-collecting kiln device placed in a microwave stove.

In a case that the workpiece P is thinner and, thus, requires a space 32 smaller than that shown in FIG. 6, an arrangement of FIG. 7 can be made. As an example, recycled glass of wine bottle shards is arranged to form a workpiece P of 3 cm×3 cm×0.6 cm. the workpiece P is placed on a piece of inorganic heat-resistant paper F on the base 5 that is supported by four legs 6. A housing 3 is placed on top of the base 5. The housing 3 is sealed by a top lid 2 having an observation hole 21. The kiln device comprised of the legs 6, base 5, housing 3, and top lid 2 is placed in a household microwave (such as model RE-0706R of Sampo Corporation, the power source is 110V/60 Hz, the frequency is 2450 MHz, and the rated microwave output is 800 W). The workpiece P is sintered by big wire through microwaves. The housing 3 concentrates, conducts, and breaks heat. The user can see the sintering condition of the workpiece P through the observation hole 21 by judging the color of emitted beams. When the beams turns from dark red (about 700° C.) into orange red (about 800° C.), the sintering can be finished in about 1 minute. The workpiece P is then took out of the microwave stove and slowly cooled to the room temperature, finishing the melting. It takes about 6 minutes from heating to complete melting by using the microwaves. Since the space is smaller in this example, the heat maintaining effect is better, and the time required for melting is shorter than that required in the example of FIG. 6.

When using the microwave stove as the heat source, the heat-conducting layer 22, 31, 51 can absorb and conduct the heat and retain the heat in the housing assembly including one or more housings. The observation hole 21 allows the user to watch the workpiece P, preventing the workpiece P from being ruined. During or after sintering, the top lid 2 can easily be opened or closed to provide an oxidization or reduction atmosphere (such as for raku ware). Furthermore, the heat-collecting kiln device according to the present invention can be used as an annealing furnace for reducing or maintaining temperature or for annealing or cooling.

The heat-collecting kiln device according to the present invention includes the following advantages:

1. According to the size and number of the workpieces as well as the needs, a housing assembly (including a single housing or a plurality of the housings having the same height or different heights with or without the heat-conducting layers) can be optionally assembled with a base, a top lid with an observation hole, a net, and four legs. Furthermore, a household microwave stove or gas stove can be used as the heat source for sintering the workpiece. The housing without a heat-conducting layer can directly heat the ornament blank containing wave-absorbing ingredients. The housing with a heat-conducting layer can indirectly heat the ornament blank to the critical temperature. Then, the temperature of the ornament workpiece is increased by directly absorbing the microwaves, accomplishing the sintering.

2. The sintering temperature and the atmosphere for oxidization or reduction can be easily controlled by the kiln device according to the present invention to suit different materials and to meet different needs, including sintering of blanks of inorganic powders of metal or ceramic or sintering of glass (liuli), ceramic glaze, enamel, and cloisonné glaze through provision of the atmosphere for oxidization or reduction.

3. The heat-collecting kiln device according to the present invention is inexpensive, eco-friendly, light, energy-saving, easy to carry, and easy to use and is, thus, suitable for small or personal studios.

4. The household microwaves or household gas stoves can be used as the heat sources according to the environments and needs.

5. Since the kiln device is made of a heat-breaking material (such as inorganic ceramic fibrous boards), during or after sintering, the internal temperature is between 500° C. and 1000° C. However, the external temperature of the kiln device allows the user to touch the kiln device with bare hands or merely wearing a pair of common cotton gloves without the risk of injury to the hands. Thus, the kiln device can be moved to any desired location according to needs.

6. The housing 3 is obtained by assembling four identical modular elements 31, with the mortise 311 of each modular element 31 engaged with the tenon 312 of another modular element 31, and with the modular elements 31 bonded by a heat-resistant inorganic adhesive. Each modular element 31 is obtained by cutting the material in the extending direction of the fibers. Thus, the housing 3 will not break even if the temperature dramatically increases or decreases.

7. The kiln device can be easily used, reconstructed, moved, and stored according to different sintering needs as wells different materials. Thus, it is not necessary to purchase various devices of different purposes. As a result, an economic, light, easy-to-carry, eco-friendly, and energy-saving heat-collecting kiln device is provided.

Although specific embodiments have been illustrated and described, numerous modifications and variations are still possible without departing from the essence of the invention. The scope of the invention is limited by the accompanying claims.

The invention claimed is:

1. A heat-collecting kiln device comprising:

a housing assembly including a single housing or a plurality of housings having a same height or different heights, with the plurality of housings stackable one upon another;

a top lid mounted on a top of the housing assembly to seal the housing assembly, with the top lid including an observation hole;

a base mounted to a bottom of the housing assembly to seal the housing assembly;

a cover mounted to the top lid to seal the observation hole, with the cover removable to reveal the observation hole;

a net; and at least one leg;

with each of the plurality of housings comprised of four modular elements each having a mortise in a first end thereof and a tenon on a second end thereof, with the mortise of each of the plurality of modular elements engaged with the tenon of another of the plurality of modular elements, with the plurality of modular elements bonded together by a heat-resistant inorganic adhesive to form the housing having upper and lower openings, with one of the plurality of modular elements including a temperature detection hole, with each of the plurality of modular elements being obtained by cutting an inorganic ceramic fibrous board in an extending direction of fibers of the inorganic ceramic fibrous board.

2. The heat-collecting kiln device as claimed in claim 1, with a heat-conducting layer capable of absorbing waves and heat coated to an exposed area of an interior wall of each of the housing assembly, the top lid, and the base.

3. The heat-collecting kiln device as claimed in claim 2, with a protecting layer of heat-resistant inorganic hardening paint applied to an area of the housing assembly that can come in contact with hands of a user.

4. The heat-collecting kiln device as claimed in claim 1, with a protecting layer of heat-resistant inorganic hardening paint applied to an area of the housing assembly that can come in contact with hands of a user.

* * * * *